US008567490B2

(12) United States Patent
Van Winkle

(10) Patent No.: US 8,567,490 B2
(45) Date of Patent: Oct. 29, 2013

(54) SHEAR SEAL BLOWOUT PREVENTER

(75) Inventor: Denzal Wayne Van Winkle, Santa Maria, CA (US)

(73) Assignee: National Oilwell Varco, L.P., Houston, TX (US)

( * ) Notice: Subject to any disclaimer, the term of this patent is extended or adjusted under 35 U.S.C. 154(b) by 142 days.

(21) Appl. No.: 12/488,130

(22) Filed: Jun. 19, 2009

(65) Prior Publication Data

US 2010/0319906 A1 Dec. 23, 2010

(51) Int. Cl.
*E21B 33/06* (2006.01)

(52) U.S. Cl.
USPC ..... 166/85.4; 251/1.3

(58) Field of Classification Search
USPC ..... 166/55, 297, 298, 85.4; 251/1.3, 1.1, 251/327; 83/694; 277/325
See application file for complete search history.

(56) References Cited

U.S. PATENT DOCUMENTS

| | | | | | |
|---|---|---|---|---|---|
| RE19,047 | E | * | 1/1934 | Hinderliter | 166/85.4 |
| 3,235,224 | A | * | 2/1966 | Grove | 251/174 |
| 3,684,008 | A | * | 8/1972 | Garrett | 166/55 |
| 3,716,068 | A | * | 2/1973 | Addison | 137/67 |
| 3,771,601 | A | * | 11/1973 | Garrett | 166/297 |
| 4,132,266 | A | * | 1/1979 | Randall | 166/55 |
| 4,132,267 | A | * | 1/1979 | Jones | 166/55 |
| 4,162,057 | A | * | 7/1979 | Qasim | 251/168 |
| 4,192,483 | A | * | 3/1980 | Combes | 251/172 |
| 4,215,749 | A | * | 8/1980 | Dare et al. | 166/361 |
| 4,332,367 | A | * | 6/1982 | Nelson | 251/1.3 |
| 4,341,264 | A | * | 7/1982 | Cox et al. | 166/55 |
| 4,508,313 | A | * | 4/1985 | Jones | 251/1.3 |
| 4,523,639 | A | * | 6/1985 | Howard, Jr. | 166/55 |
| 4,612,983 | A | | 9/1986 | Karr, Jr. | |
| 4,646,825 | A | | 3/1987 | Van Winkle | |
| 4,671,312 | A | * | 6/1987 | Bruton | 137/315.29 |
| 4,911,410 | A | * | 3/1990 | Baker | 251/327 |
| 4,938,290 | A | * | 7/1990 | Leggett et al. | 166/387 |
| 4,997,162 | A | * | 3/1991 | Baker et al. | 251/327 |
| 5,199,493 | A | | 4/1993 | Sodder, Jr. | |

(Continued)

FOREIGN PATENT DOCUMENTS

| | | |
|---|---|---|
| GB | 2352494 | 4/2003 |
| WO | 03/014604 | 2/2003 |

OTHER PUBLICATIONS

PCT/GB2010/051024 International Search Report and Written Opinion dated Jan. 31, 2011, 8 pages.

(Continued)

*Primary Examiner* — David Andrews
*Assistant Examiner* — Wei Wang
(74) *Attorney, Agent, or Firm* — The JL Salazar Law Firm

(57) ABSTRACT

A shear/seal ram provides a knife edge at the shearing edge and the knife edge is inclined to minimize the cutting force required and to leave a clean cut edge. The knife edge is presented in an opening of the ram, thus the opening is positioned at the axis of the BOP, and consequently the coiled tubing, before the coiled tubing is run through the BOP. A biasing means, such as for example a Bellville spring, forces a sealing sleeve against the underside of the ram to prevent leakage of pressure from below the BOP. Similarly, a plurality of biasing means, referred to herein as "skates", forces the ram down against the sealing sleeve to seal pressure from above the BOP.

15 Claims, 9 Drawing Sheets

(56) References Cited

U.S. PATENT DOCUMENTS

| | | | | |
|---|---|---|---|---|
| 5,360,061 | A * | 11/1994 | Womble | 166/55 |
| 5,400,857 | A | 3/1995 | Whitby et al. | |
| 5,501,424 | A * | 3/1996 | Williams et al. | 251/1.3 |
| 5,515,916 | A | 5/1996 | Haley | |
| 5,590,867 | A | 1/1997 | Van Winkle | |
| 5,775,420 | A * | 7/1998 | Mitchell et al. | 166/85.4 |
| 5,944,110 | A * | 8/1999 | Watts et al. | 166/320 |
| 6,173,770 | B1 * | 1/2001 | Morrill | 166/85.4 |
| 6,244,336 | B1 * | 6/2001 | Kachich | 166/55 |
| 6,454,015 | B1 * | 9/2002 | Armstrong et al. | 166/387 |
| 6,719,042 | B2 | 4/2004 | Johnson et al. | |
| 6,845,959 | B2 * | 1/2005 | Berckenhoff et al. | 251/1.3 |
| 7,011,159 | B2 | 3/2006 | Holland | |
| 7,086,467 | B2 * | 8/2006 | Schlegelmilch et al. | 166/298 |
| 7,207,382 | B2 * | 4/2007 | Schaeper | 166/55 |
| 7,225,873 | B2 * | 6/2007 | Schlegelmilch et al. | 166/298 |
| 7,234,530 | B2 | 6/2007 | Gass | |
| 7,243,713 | B2 * | 7/2007 | Isaacks et al. | 166/85.4 |
| 7,410,003 | B2 * | 8/2008 | Ravensbergen et al. | 166/384 |
| 7,464,765 | B2 | 12/2008 | Isaacks et al. | |
| 7,721,808 | B2 * | 5/2010 | Dallas et al. | 166/379 |
| 7,975,761 | B2 * | 7/2011 | Berckenhoff et al. | 166/85.4 |
| 8,353,338 | B2 | 1/2013 | Edwards | |
| 2003/0029619 | A1 * | 2/2003 | Sundararajan | 166/361 |
| 2003/0132004 | A1 * | 7/2003 | Suro | 166/380 |
| 2005/0045846 | A1 * | 3/2005 | Iwabuchi | 251/193 |
| 2006/0144586 | A1 * | 7/2006 | Urrutia | 166/55 |
| 2007/0075288 | A1 * | 4/2007 | Matte et al. | 251/167 |
| 2007/0236006 | A1 * | 10/2007 | Fultz et al. | 285/96 |
| 2007/0246215 | A1 * | 10/2007 | Springett et al. | 166/298 |
| 2008/0135791 | A1 * | 6/2008 | Juda et al. | 251/1.3 |

OTHER PUBLICATIONS

PCT/GB2010/051024 International Preliminary Report on Patentability dated Dec. 20, 2011, 6 pages.

* cited by examiner

FIG.3C
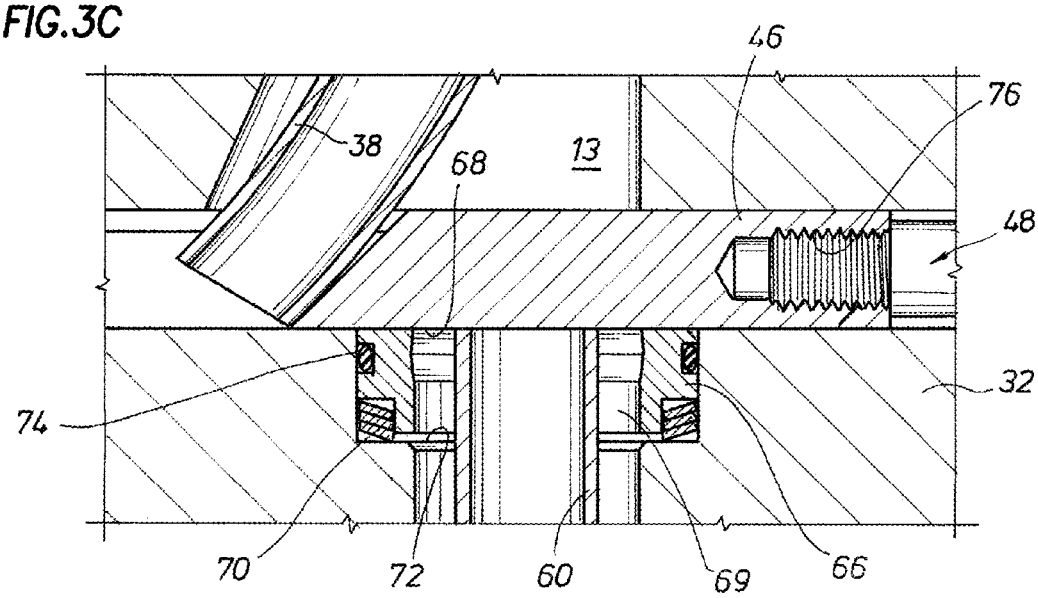
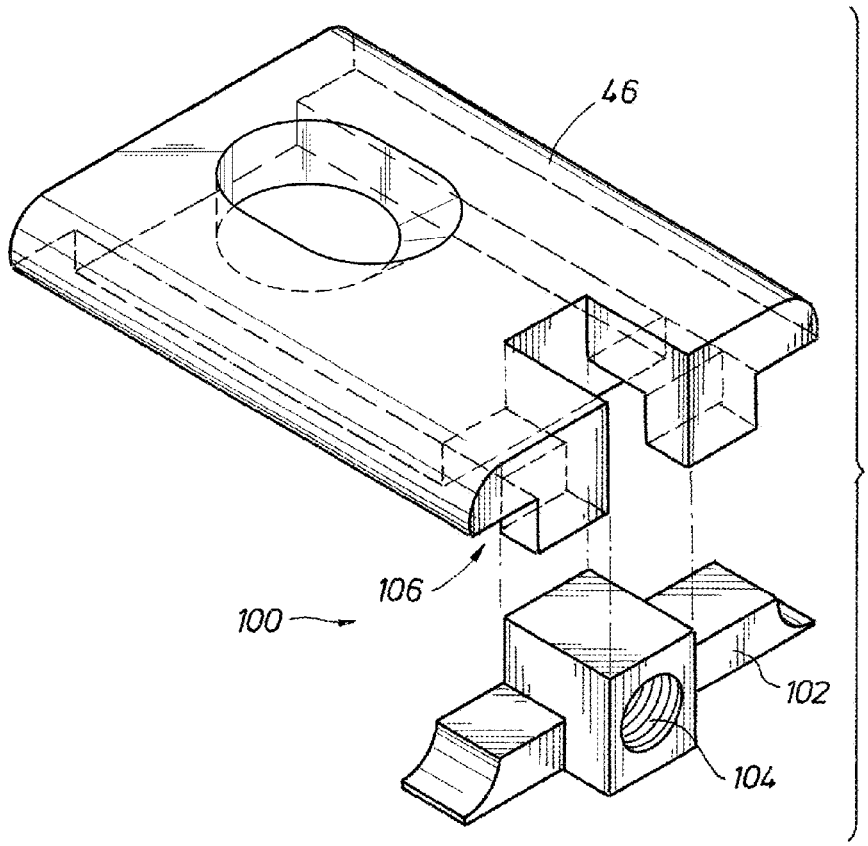
FIG.6

SHEAR SEAL BLOWOUT PREVENTER

FIELD OF THE INVENTION

The present invention relates generally to the field of ram-type blowout preventers (BOPs) used in oil and gas operations for well control including preventing a well blowout. In particular, the present invention relates to a shear/seal ram assembly used in ram-type BOPs that eliminates certain polymeric components to complete the seal in such a BOP and provides a clean shear cut of coiled tubing through the BOP.

BACKGROUND OF THE INVENTION

Various arrangements have been used to shear elongated objects such as tubular members or coiled tubing extending through a blowout preventer (BOP) and then attempting to block or seal off communication through the BOP after the tubular object has been sheared. Some of such devices include shear arrangements which are generally rectangular in configuration but the configuration or arrangement is such that it may collapse or crush the ends of the tubular member being severed, particularly where the member is thin walled. Also, the sealing arrangement employed with such shear blades is generally unsatisfactory in that it may not adequately and positively seal or block off communication through the BOP after the tubular members or other object has been severed.

A solution to these and other problems was disclosed in my earlier U.S. Pat. No. 4,646,825. In the '825 patent, opposed rams were sealably and reciprocally mounted in a body with opposed shear blades projecting from one end of each ram for movement toward each other to sever an elongated object extending between the rams and blades. A seal was provided on each blade and configured to sealingly receive therein the exposed portion of the opposed blade after the object has been severed, and each ram was provided with a cut out portion to receive the adjacent severed end of the elongated object to inhibit crushing thereof.

While the structure disclosed in the '825 patent has proved successful, it still suffers from the drawback that the ram element requires a polymeric seal component. It is known that polymeric components of all types become brittle with age, particularly in the harsh environment of a blowout preventer. If the seal element becomes brittle, then the seal can leak by, reducing the effectiveness for which the BOP was installed.

Other typical shear/seal-type rams include a well head gate valve to shear coiled tubing and the well pressure. Such a gate valve does not have any exposed elastomer on the gate, which acts as the shearing member, but does indeed include an O-ring or similar polymeric seal on the piston rod and sealing seat. The gate valve shear seal arrangement, however, introduces its own drawbacks. For example, once the gate valve shear ram is shut, it cuts the coiled tubing at the top and the bottom of the gate, since the gate presents a square edge against the surface of the coiled tubing. Then, when the gate is opened once more, the resulting stub or severed segment of the coiled tubing may drop into the well.

Also, the square edge of the gate is not an efficient shearing device, requiring high shearing forces to shear the coiled tubing and therefore limiting the size and wall thickness of the coiled tubing that can be sheared. Further, the sheared tubing is not cut cleanly, and is prone to damaging the gate as it passes over the ragged edge of the sheared tubing. This phenomenon can cause the valve to leak.

This type of known shear also suffers from the drawback in that the tubing is completely or almost completely closed, which may impair circulation and recovery operations. The shear/seal function of a BOP is used in the event of an emergency requiring control of the well to prevent flow of gas or liquids, and normal operations will be performed to bring the well back to controlled condition. Control involves reconnecting to the "fish" (the portion of tubing left in the well), pumping fluid, generally weighted to a higher specific gravity than the fluids in the well at the time of the emergency, through the fish, and returned to the surface reservoir, to clear the well of gas, or light hydrocarbons. Connecting to a flattened tubing, and then pumping fluids through it is not possible without remedial operations to mill away the flatten portion of the tubing. This is not easy anytime, but becomes a delicate operation with high pressure gas at the wellhead. The double cut piece of tubing (biscuit) may also become a problem, fouling some piece of down hole equipment.

Thus, there remains a need for a shear/seal ram-type BOP that provides an effective seal without a polymeric seal component on the ram, although polymeric components may be used in other components of the BOP that remained sealed. The shear/seal should cleanly shear the coiled tubing, and not result in a cutoff stub or biscuit that can fall into the well. The shear/seal ram should allow for circulation through the tubing to promote recovery operations, and it should increase the size and wall thickness of coiled tubing that can be efficiently sheared, relative to shear/seal rams currently in place. The present invention is directed to filling these and other needs in the art.

SUMMARY OF THE INVENTION

The shear/seal ram disclosed herein solves these drawbacks by providing a knife edge in a shearing orifice and the knife edge is inclined to minimize the cutting force required and to leave a clean cut edge. The knife edge is presented in the orifice or opening of the ram, thus the opening is positioned at the axis of the BOP, and consequently the coiled tubing, before the coiled tubing is run through the BOP. A biasing means, such as for example a Bellville spring, forces a metal sealing sleeve against the underside of the ram to prevent leakage of pressure from below the BOP. Similarly, a plurality of biasing means, referred to herein as "skates", forces the ram down against the sealing sleeve to seal pressure from above the BOP.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 3C is a detail view of spring loaded ram sealing means.

FIG. 6 is a detail perspective view of a preferred coupling between the rod and the ram of the BOP.

DETAILED DESCRIPTION OF A PREFERRED EMBODIMENT

Figure 1:
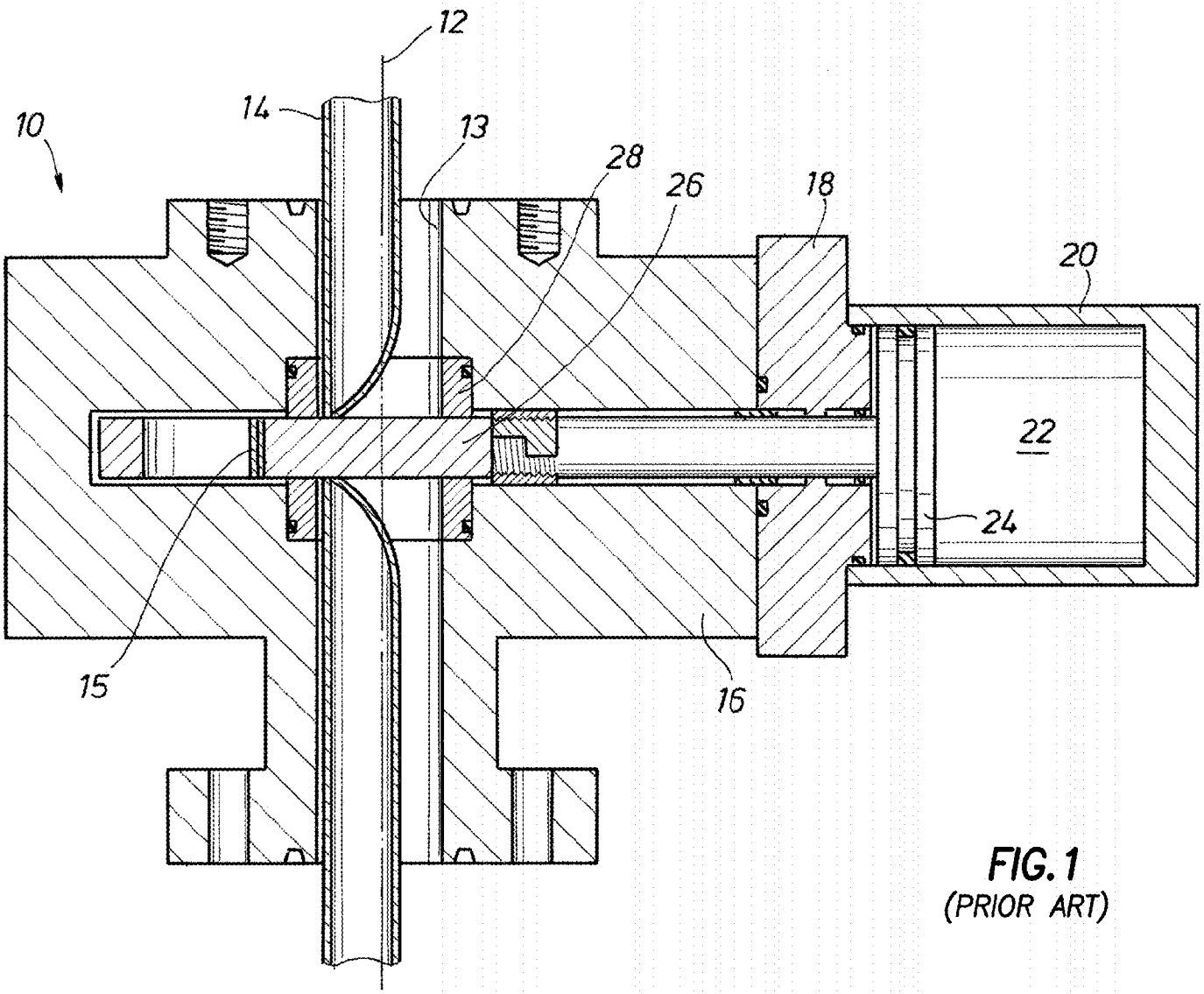
FIG. 1 (PRIOR ART)
FIG. 1 is a side section view of a prior art shear/seal ram.

FIG. 1 depicts a known shear/seal ram-type BOP 10 oriented along an axis 12 of a bore 13. The BOP 10 is shown in an actuated condition, having sheared a coiled tubing 14. Thus, a section 15 (referred to as a "biscuit") of the coiled tubing 14 has been removed from the coiled tubing, and may ultimately fall down the bore or otherwise interfere with further operation or recovery of the BOP.

The BOP 10 includes a body 16 through which the bore 13 is formed. A seal cap 18 is secured to the body 16, such as by bolting, and the seal cap 18 supports a cylinder body 20. A chamber 22 within the cylinder body 20 actuates a piston 24 which is operatively coupled to a shear ram 26. The shear ram 26 is moved back and forth horizontally, perpendicular to the bore 13, and is sealed on the top and bottom of the shear ram by a polymeric seal 28 in this prior art BOP. Clearly, if the seal 28 deteriorates, the BOP is likely to leak once actuated. Note also that the sections of the coiled tubing 14 above and below the ram 26 are sealed off, making recovery efforts difficult, at best.

Figure 2A:
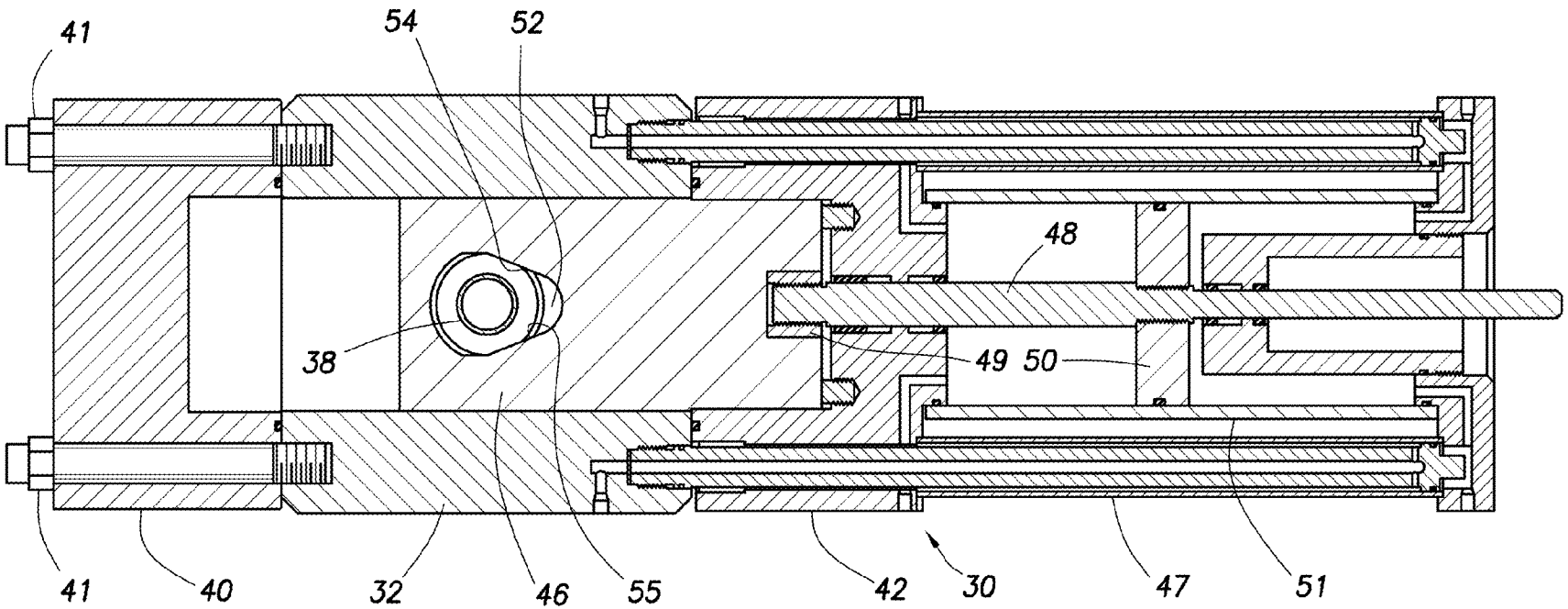
FIG. 2A is a top section view of a shear/seal-type BOP of the present invention in an open condition.
Figure 2B:
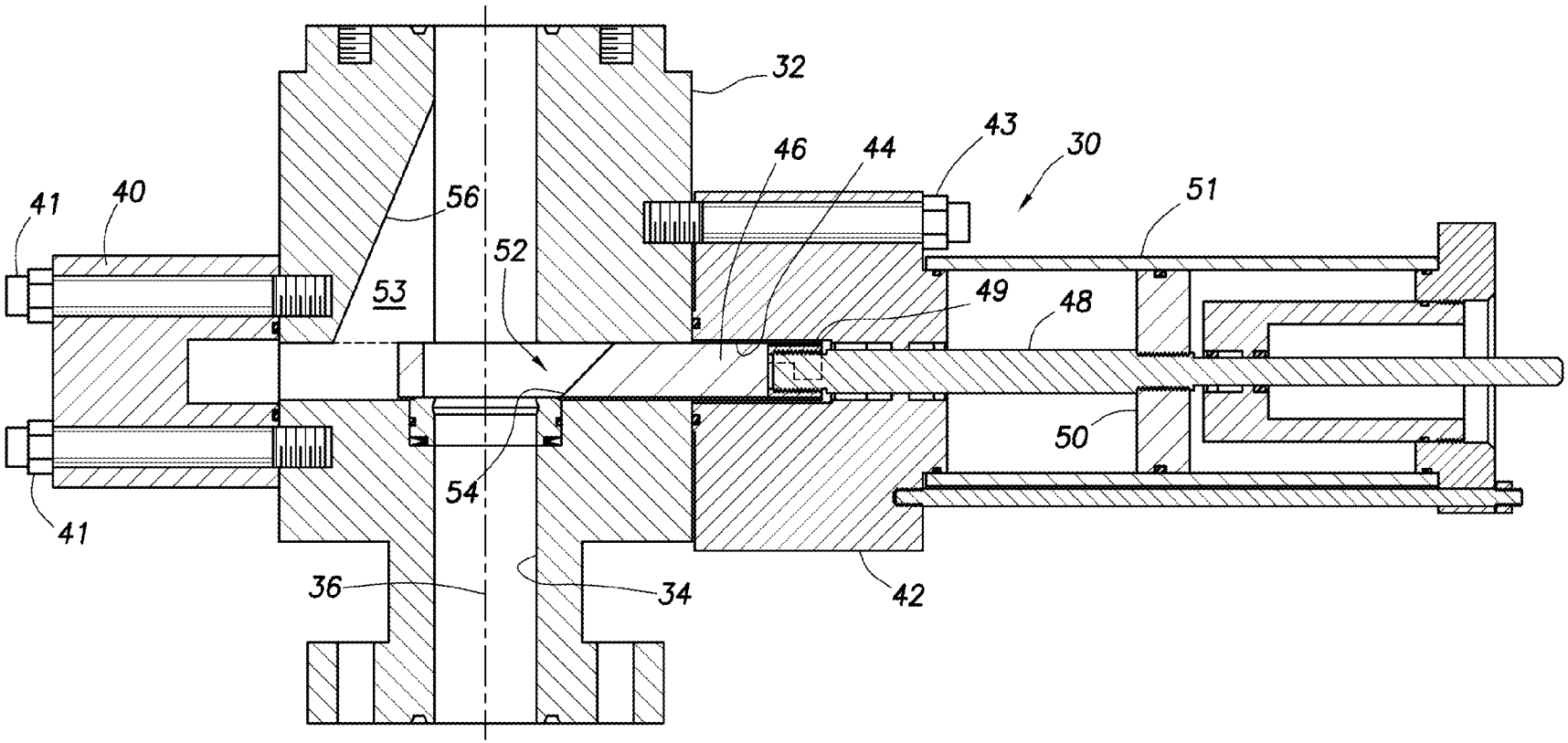
FIG. 2B is a side section view of the shear/seal-type BOP of FIG. 2A.

FIGS. 2A and 2B show a new shear/seal BOP 30 constructed in accordance with the teachings of the present invention. The BOP 30 is shown in FIGS. 2A and 2B in a condition ready for actuation, i.e. in an open condition. The BOP 30 comprises a body 32 with a bore 34 oriented along an axis 36. As previously described, coiled tubing 38 is positioned through the BOP (not shown in FIG. 2B for clarity) aligned along the axis 36. Bolted to the side of the body 32 is a ram-receiving chamber 40 mounted to the body 32 with a set of mounting bolts 41 or other appropriate means.

Opposite the ram-receiving chamber 40 is a bonnet 42 which is arranged to support and guide the operable components of the shear/seal ram portion of the BOP 30. As used herein, the term "shear/seal ram mechanism" refers to the operable components of the shear/seal ram. The bonnet 42 may be mounted to the body with a plurality of bolts 43 or other appropriate means. The bonnet 42 defines a bore 44 therethrough which is adapted to receive a ram 46, shown and described in greater detail below. The ram 46 is operatively coupled to a rod 48 at a coupling 49 which is moved transversely back and forth by a piston 50 retained within a cylinder 51. It should be noted that a common, known shear/seal type BOP includes a pair of mutually opposed rams which are simultaneously actuated to shear the coiled tubing from both sides, while in the configuration shown in FIGS. 2A and 2B only a single ram 46 is used.

FIG. 2A also shows that the BOP may include a self-contained hydraulic cylinder system 47 to open and close the bonnet 42 of the BOP to replace rams in the field. Actuation of the hydraulic cylinder system 47 pulls the bonnet back away from the body 32, bringing the ram 46 with it, so that the ram can be changed.

The body also defines a severed tubing receiving cavity 53 which defines an angled upper surface 56. The cavity 53 provides a volume to receive the upper portion of the severed coiled tubing, as shown and described below.

The ram 46 includes a ram bore 52 through the ram. When the shear/seal ram is in the open position, as shown in FIGS. 2A and 2B, the coiled tubing 38 passes through the ram bore 52. The ram bore 52 also defines a knife edge 54 in operable position to shear the coiled tubing when the shear/seal ram is actuated. As the knife edge 54 shears the coiled tubing, the upper portion of the coiled tubing is moved to the left as see in FIG. 2B into the cavity 53 without creating a biscuit as shown and described above in respect of FIG. 1. As shown in FIG. 2A, the bore 52 preferably forms a knife edge 54 with a pair of opposing substantially straight edges 55 which provide a guillotine action against the coiled tubing when the ram is shut.

Figure 3A:
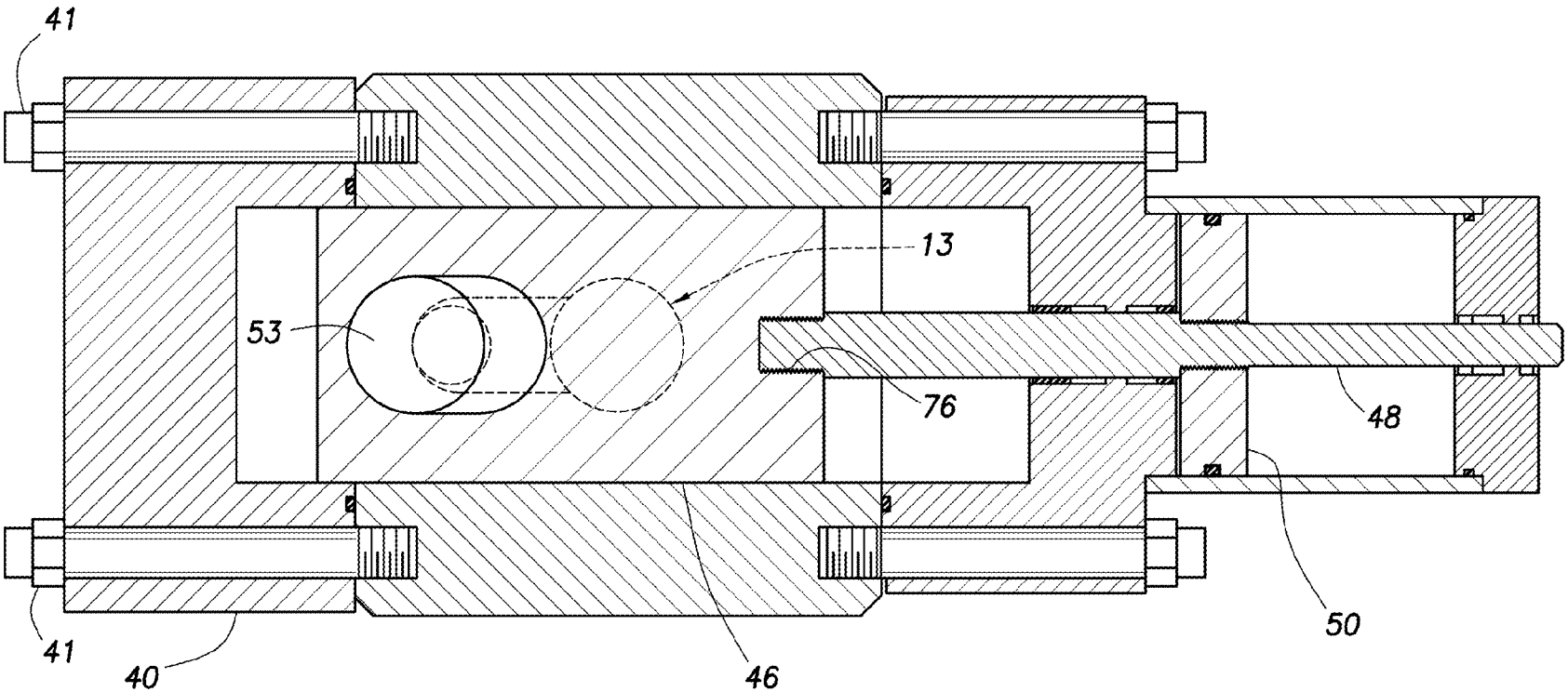
FIG. 3A is a top section view of a shear/seal-type BOP of the present invention in a shut configuration.
Figure 3B:
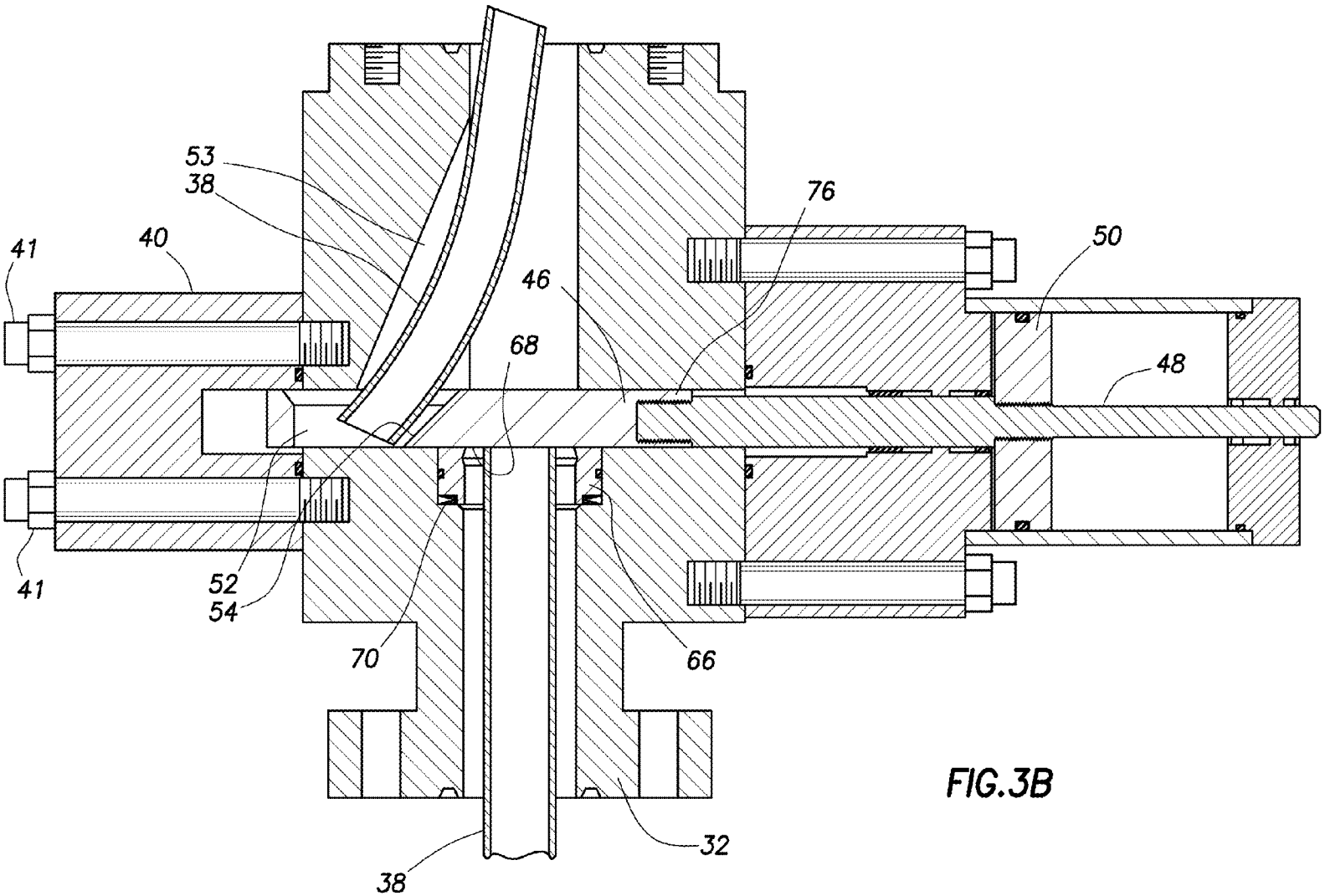
FIG. 3B is a side section view of the shear/seal-type BOP of FIG. 3A.

FIGS. 3A and 3B illustrate the ram in the shut position and FIG. 3C shows further details of a sealing arrangement for the ram 46. FIG. 3A illustrates that the ram bore 52 may alternatively provide a circular aspect, rather than the tear-drop aspect shown in FIG. 2A with the opposing straight edges. Once the ram 46 is shut, if pressure is higher below the ram than above the ram, a shear/seal ring 66 is pressed against an underside 68 of the ram to seal in the pressure under the ram within an annulus 69. As shown in greater detail in FIG. 3C, the seal ring 66 is spring loaded by a Bellville spring 70 which is supported on a shoulder 72 extending outwardly from the bore 13. The seal ring is also sealed against the body 32 of the shear/seal element with an O-ring 74. A simple O-ring seal is shown to illustrate the BOP, although a seal with protector rings to provide zero extrusion clearance may be used within the scope and spirit of this invention. Note also that the rod 48 is shown coupled to the ram 46 with a threaded coupling 76, although other coupling means may be used, as described below.

Figure 4A:
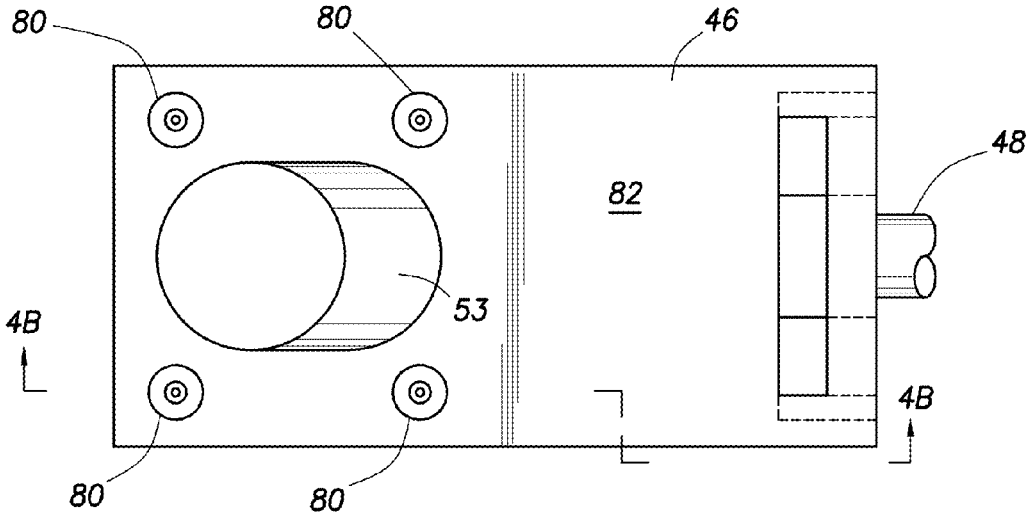
FIG. 4A is a top view of a ram in accordance with this invention.
Figure 4B:
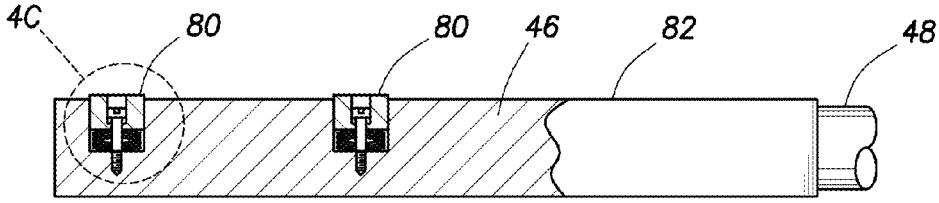
FIG. 4B is side section view of the ram of FIG. 4A as seen along section lines B-B.
Figure 4C:
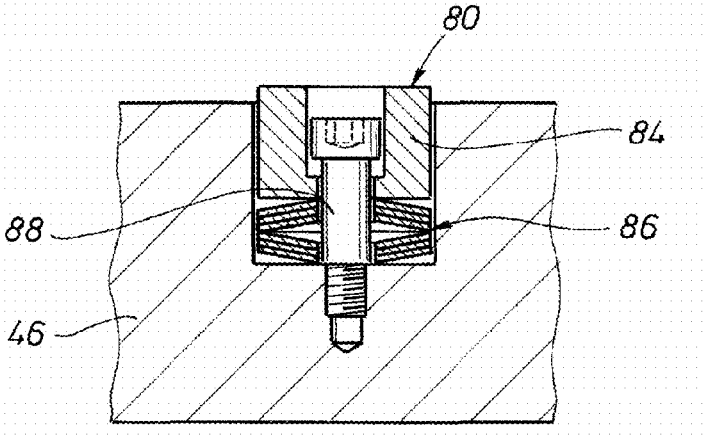
FIG. 4C is a side section detail view of a skate, which is a component part of the ram of FIG. 4B.

If pressure is greater above the ram than below the ram 46, then a different sealing arrangement is called for, as shown in FIGS. 4A, 4B, and 4C. It is to be understood that the sealing arrangements for pressures above and below the ram are shown and described separately, the sealing arrangements are both to be included in the BOP. As shown in FIGS. 4A and 4B a plurality of skates 80 are mounted into the top surface 82 of the ram 46. One such skate 80 is shown in FIG. 4C. The skate 80 comprises a body 84 which is biased upward by a spring 86. The body is mounted to the ram 46 by a bolt 88 which also allows the spring 86 to move the body 84 upward. When the ram is shut (actuated), the skates are pressed against the ram receiving chamber 40 or the body 32, depending on the location of the skate as appropriate. This action presses the ram 46 down onto the seal ring 66, sealing off the ram from leakage.

Figure 5B:
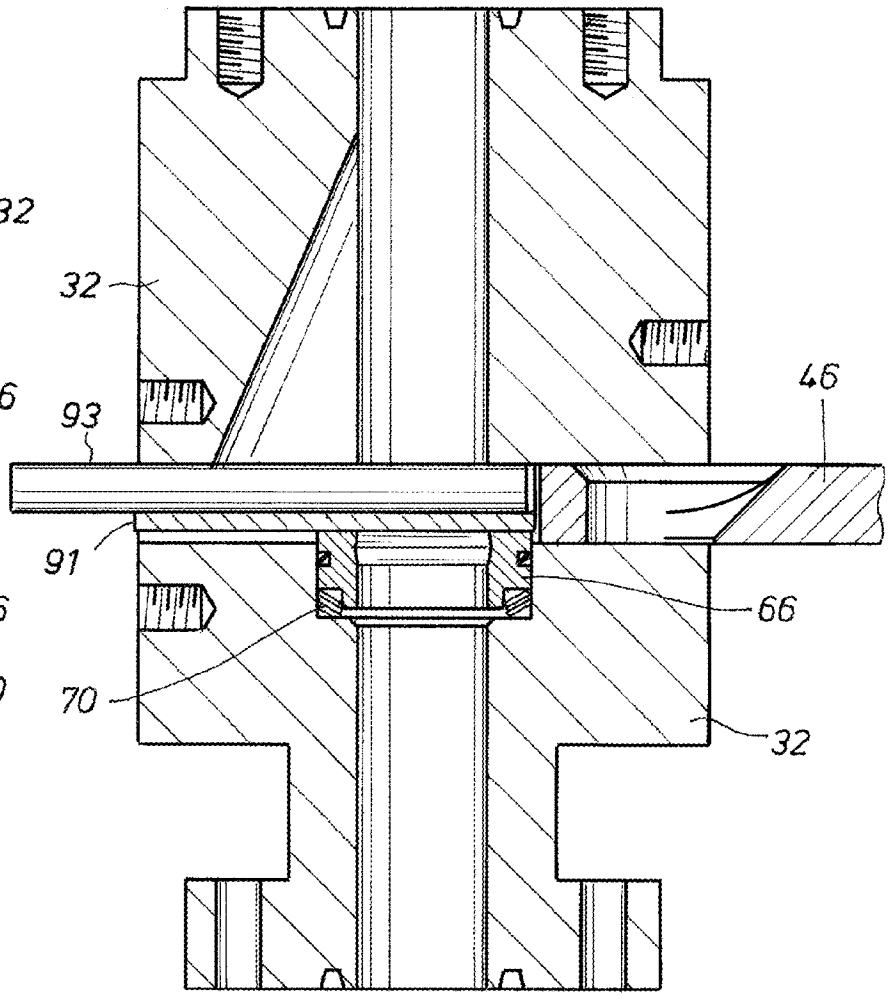
FIG. 5B is a front section view of the body of FIG. 5A.
Figure 5A:
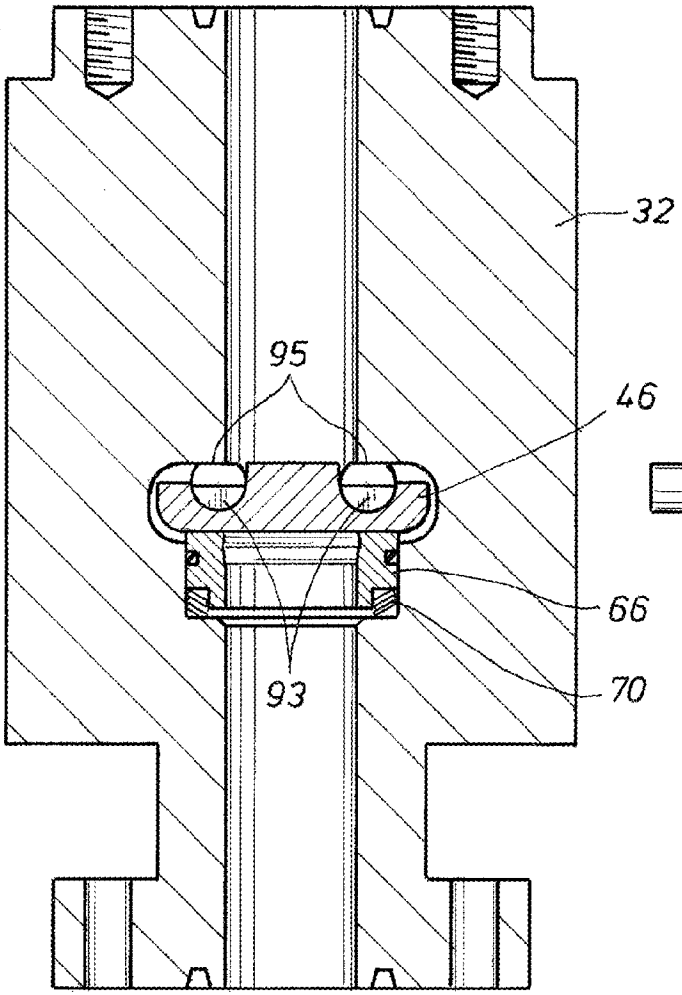
FIG. 5A is a side section view of the body of the BOP showing depressor rods used in the assembly of the spring loaded elements to seal the BOP.
Figure 5D:
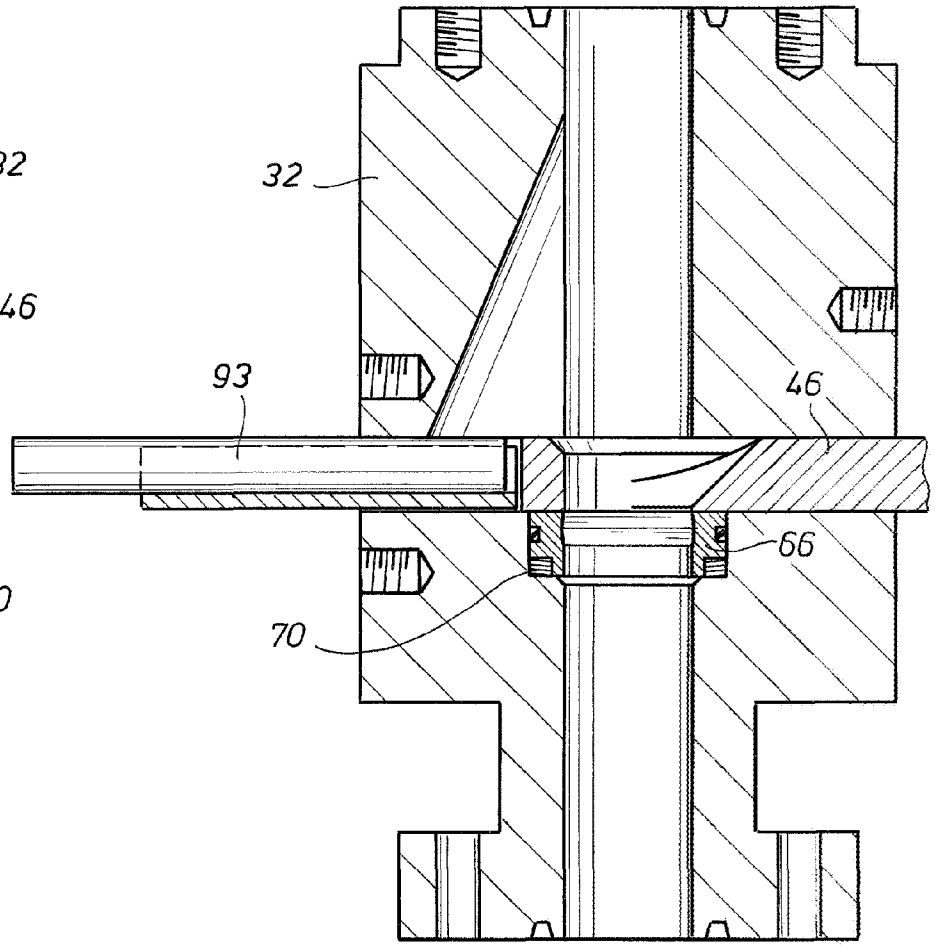
FIG. 5D is a front section view of the body of FIG. 5C.
Figure 5C:
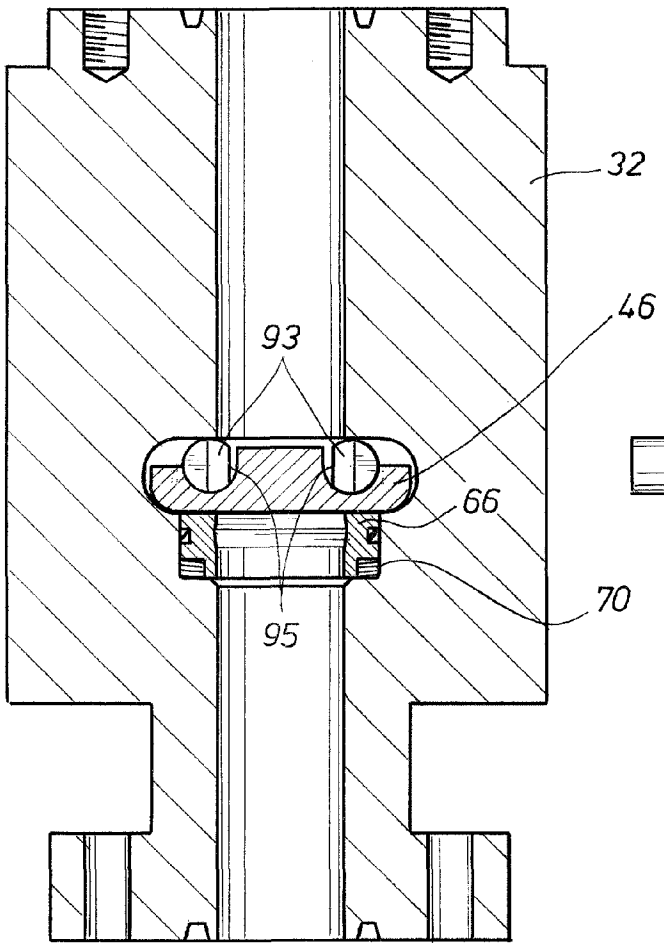
FIG. 5C is a side section view of the body with the depressor rods rotated 90° to compress the seal biasing means and seat the seal.

In order to make the assembly of the spring loaded elements just described possible, the arrangements of FIGS. 5A through 5D have been developed. As previously described in respect of FIG. 3C, the seal ring 66 is spring loaded by a Bellville spring 70 (see FIG. 3C), which moves the seal up as seen in FIGS. 5A and 5B. With the seal ring 66, seal 74, and springs 70, assembled into position, the seal interferes with the insertion of the ram elements. To overcome this problem, a depressor 91, and a pair of depressor rods 93 with a flat side 95 positioned in an up orientation, are installed to the positions as shown in FIG. 5B. The depressor rods are then rotated 90°, as illustrated in FIG. 5C, which will compress the Bellville spring 70, bringing the top surface of the seal ring 66 below the lower leading edge plane of the ram 46. The ram can then be moved to the closed position, pushing the depressor assembly ahead. Rotating the depressor rods to a position with the flat sides up thus will free the assembly for removal. Bolting the bonnet 42, and receiver 40 to the body, completes the installation of the ram.

Finally, as previously described, the coupling between the ram 46 and the rod 48 is shown in FIGS. 3A and 3B as a threaded coupling 76, for ease of illustration. However, a coupling 100 illustrated in FIG. 6 is presently preferred. The coupling comprises a pedestal member 102 adapted to receive the rod 48 at a threaded hole 104. The pedestal member 102 mates with a complementary cavity 106. This arrangement distributes the stress of the mechanism between the rod and the ram, and is therefore more robust.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A blowout preventer of the shear/seal ram type, comprising:

a body;

an axial bore through the body adapted to receive tubing;

a lateral bore extending laterally from the axial bore;

a shear/seal ram mechanism comprising a shear ram movable back and forth in the lateral bore, the shear ram having a ram bore receiving the tubing therethrough, the shear ram defining a knife edge, the ram bore having a linear inclined surface extending from the knife edge at a bottom of the shear ram and adapted to receive the tubing through the ram bore during shearing; and a severed tubing receiving cavity extending radially outwardly from the axial bore above the shear ram, the severed tubing receiving cavity defining an angled surface contiguous with the axial bore, the severed tubing receiving cavity extending radially about a portion of the axial bore and defining a volume shaped to receive the tubing as the tubing is severed by the shear ram.

2. The blowout preventer of claim 1, further comprising a biasing means to bias a seal against a bottom surface of the shear ram, wherein the biasing means comprises a Bellville spring.

3. The blowout preventer of claim 1 wherein the ram defines a top surface, and further comprising a plurality of skates in the top surface of the ram to bias the ram in a downward direction.

4. The blowout preventer of claim 1, wherein the ram bore defines a pair of opposed straight edges angled relative to one another.

5. The blowout preventer of claim 1, further comprising a depressor insertable into the ram-receiving chamber for compressing the seal.

6. The blowout preventer of claim 1, further comprising:

a rod coupled to the shear ram; and a hydraulic cylinder operably coupled to the rod;

a shelf formed in the body about the axial bore below the shear ram; and a seal on the shelf; and a biasing means adapted to bias the seal biased against a bottom surface of the shear ram.

7. A blowout preventer of the shear/seal ram type comprising:

a body;

an axial bore through the body adapted to receive coiled tubing;

a ram-receiving chamber extending laterally from the axial bore;

a shear/seal ram mechanism extending laterally from the axial bore opposite the ram-receiving chamber, the shear/seal ram mechanism comprising:

a shear ram defining a knife edge and a bottom surface, the shear ram having a linear inclined surface extending from the knife edge at a bottom of the shear ram, the shear ram having a ram bore adapted to receive the tubing during shearing;

a rod coupled to the shear ram; and a hydraulic cylinder operably coupled to the rod;

a shelf formed in the axial bore below the shear ram;

a seal on the shelf;

a biasing means adapted to bias a seal against the bottom surface of the shear ram; and a severed tubing receiving cavity extending radially outwardly from the axial bore above the ram-receiving chamber, the severed tubing receiving cavity defining an angled upper surface contiguous with the axial bore, the severed tubing receiving cavity extending radially about a portion of the axial bore and defining a volume shaped to receive the tubing as the tubing is severed by the shear ram.

8. The blowout preventer of claim 7, wherein the shear ram defines a ram bore therethrough, the ram bore defining the knife edge, the ram bore adapted to receive coiled tubing through the ram bore.

9. The blowout preventer of claim 7, wherein the biasing means comprises a Bellville spring.

10. The blowout preventer of claim 7 wherein the ram defines a top surface, and further comprising a plurality of skates in the top surface of the ram to bias the ram in a downward direction.

11. The blowout preventer of claim 7, wherein the ram bore defines a pair of opposed straight edges angled relative to one another.

12. The blowout preventer of claim 7, further comprising a depressor insertable into the ram-receiving chamber for compressing the seal.

13. A blowout preventer for a tubing of a wellbore, comprising:

a body having an axial bore receiving the tubing therethrough and a lateral bore extending laterally from the axial bore; and a shear ram slidably positionable in the lateral bore, the shear ram having a ram bore receiving the tubing therethrough, the ram bore defining a knife edge engageable with the tubing whereby the tubing is severed, the ram bore having a linear inclined surface extending from the knife edge at a bottom of the shear ram and adapted to receive the tubing through the ram bore as the tubing is severed;

wherein the body has a severed tubing receiving cavity extending between the lateral bore and the axial bore, the severed tubing receiving cavity extending radially about a portion of the axial bore and defining a volume shaped to receive the tubing as the tubing is severed by the shear ram.

14. The blowout preventer of claim 13, further comprising:

a shelf formed in the body about the axial bore below the shear ram; and a seal on one side of the shear ram, the seal positionable on the shelf and biased against a bottom surface of the shear ram.

15. A method of preventing a blowout for a tubing of a wellbore, comprising:

providing a body having an axial bore and a lateral bore extending laterally from the axial bore, the body having a severed tubing receiving cavity extending between the lateral bore and the axial bore, the severed tubing receiving cavity extending radially about a portion of the axial bore and defining a volume shaped to receive the tubing as the tubing is severed by a shear ram;

slidably positioning the shear ram in the lateral bore, the shear ram having a ram bore receiving the tubing therethrough, the ram bore defining a knife edge, the ram bore having a linear inclined surface extending from the knife edge at a bottom of the shear ram and adapted to receive the tubing through the ram bore during shearing;

receiving the tubing in the axial bore;

severing the tubing by engaging the knife edge with the tubing; and receiving the tubing in the severed tubing receiving cavity as the tubing is severed by the shear ram.

* * * * *